United States Patent [19]

Achelpohl et al.

[11] 4,372,436

[45] Feb. 8, 1983

[54] APPARATUS FOR DEFLECTING FLAT WORKPIECES THROUGH 180° WITH SIMULTANEOUS ROTATION THROUGH 90°

[75] Inventors: Fritz Achelpohl; Richard Feldkamper, both of Lengerich, Fed. Rep. of Germany

[73] Assignee: Windmoller & Holscher, Lengerich, Fed. Rep. of Germany

[21] Appl. No.: 196,122

[22] Filed: Oct. 10, 1980

[30] Foreign Application Priority Data

Oct. 10, 1979 [DE] Fed. Rep. of Germany ..... 2941151

[51] Int. Cl.[3] ..... B65G 29/00

[52] U.S. Cl. ..... 198/377; 198/412; 198/459; 271/184; 271/225; 271/273

[58] Field of Search ..... 198/626, 479, 377; 271/225, 184, 272–274; 199/412, 457

[56] References Cited

U.S. PATENT DOCUMENTS 3,421,758 1/1969 Cole .

3,779,546 12/1973 Wojtawicz et al. ..... 271/184 X 4,066,162 1/1978 Miaskoff ..... 198/479 X

FOREIGN PATENT DOCUMENTS 1057862 5/1959 Fed. Rep. of Germany .

*Primary Examiner*—John J. Love

*Assistant Examiner*—Paul A. Sobel

*Attorney, Agent, or Firm*—Fleit & Jacobson

[57] ABSTRACT

In a bag-making machine comprising a tube-making device and a device parallel thereto for forming bases on flattened individual tube sections fed longitudinally from the tube-making device, an apparatus for deflecting the tube sections comprises spaced parallel double belt conveyors respectively leading to and from a transverse double belt conveyor. A first turning device transfers the tube sections from one of the parallel conveyors to the transverse conveyor so that they continue to be fed longitudinally and a second turning device ensures that the tube sections are fed transversely to the base-forming device.

2 Claims, 4 Drawing Figures

APPARATUS FOR DEFLECTING FLAT WORKPIECES THROUGH 180° WITH SIMULTANEOUS ROTATION THROUGH 90°

The invention relates to an apparatus for deflecting continuously conveyed flat workpieces, preferably tube sections having side folds, through 180° while turning the workpieces through 90°.

Lack of space frequently makes it impossible to process flat workpieces ejected from and continuously fed away from a manufacturing machine in a downstream processing machine if both machines are disposed on a rectilinear production line. The problem of a space-saving arrangement of production machines arises for example in the manufacture of sacks where the tube-making machine and the downstream base-forming machine are usually juxtaposed in a straight line.

It is therefore the problem of the present invention to provide a deflecting apparatus with which workpieces fed continuously in their longitudinal direction can be transferred in a transverse position to a parallel conveying line with an opposite direction of feeding in order thereby to enable the processing machines to be juxtaposed on a space-saving manner.

According to the invention, this problem is solved by the combination of the following features:

(a) Two double belt conveyors comprising spaced conveyor belts travelling in parallel in opposite directions are spaced apart and parallel.

(b) Transversely to the double belt conveyors in front of the delivery and supply ends thereof, respectively, a double belt conveyor bridges the spacing therebetween and has endless conveyor belts divided in the same manner.

(c) On the inside of the angle formed by the transversely extending double belt conveyor and one of the two parallel belt conveyors there are turning means with at least two pairs of grippers which co-operate in the manner of tongs, are disposed on a radial line, engage between every two conveyor belts of the double belt conveyors and are provided with a control that opens the gripper halves when the conveyor belts are being passed and closes them between same, and that takes over the workpieces from the supplying conveyor substantially tangentially and, after rotation through 90°, delivers same substantially tangentially after their introduction into the belt nip of the following perpendicular double belt conveyor.

(d) On the inside of the angle formed by the transversely extending double belt conveyor and the other of the two parallel belt conveyors there is a transfer device consisting of at least one pair of parallel arms which extend radially to their common rotary axis and are provided with parallel guide gearing for a respective carrier near the ends of the arms that is secured to a shaft parallel to the rotary axis, wherein at least two gripper halves pivoted to each carrier co-operate in the manner of tongs with gripper halves on the opposite carrier and wherein the grippers formed by the gripper halves take over the workpieces from the supplying double belt conveyor substantially tangentially and deliver same substantially tangentially parallel to themselves into the belt nip of the following perpendicular double belt conveyor and are provided with controls which open the gripper halves when the conveyor belts are being passed and close them again between same.

By means of the apparatus of the invention, flat workpieces can be deflected in rapid sequence without unintentional displacement or slipping because they are constantly clamped between the conveyor belts of the double belt conveyors or the grippers of the turning and transverse devices. If the flat workpieces are tube sections provided with side folds, they will not tend to spring open because they are constantly clamped. The apparatus can be incorporated in one frame so that it can interconnect juxtaposed production machines as a readily and rapidly installable unit.

A turning device connecting belt conveyors which are at right-angles to each other is known from U.S. Pat. No. 3,421,758.

DE-PS No. 10 57 862 discloses a transfer device which transfers flat workpieces parallel to themselves from a supplying conveyor to a further conveyor at right-angles thereto and comprises parallel guide gearing for grippers which engage the workpieces.

The turning and transfer devices preferably have a plurality of arms so that a low amount of precession of the workpieces will be adequate.

One example of the invention will be described in more detail with reference to the drawing, wherein.

Figure 1:
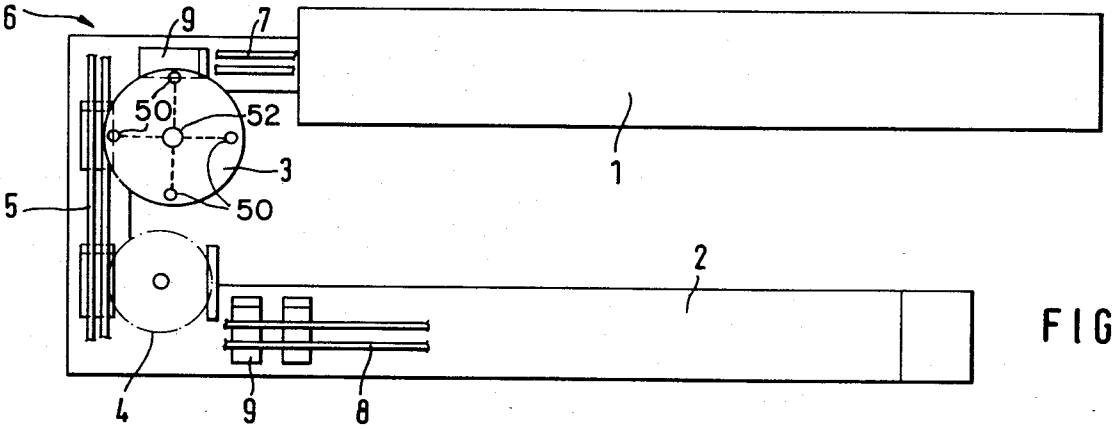
FIG. 1 is a diagrammatic plan view of a deflecting apparatus connecting a tube-making machine to a base-forming machine.
Figure 4:
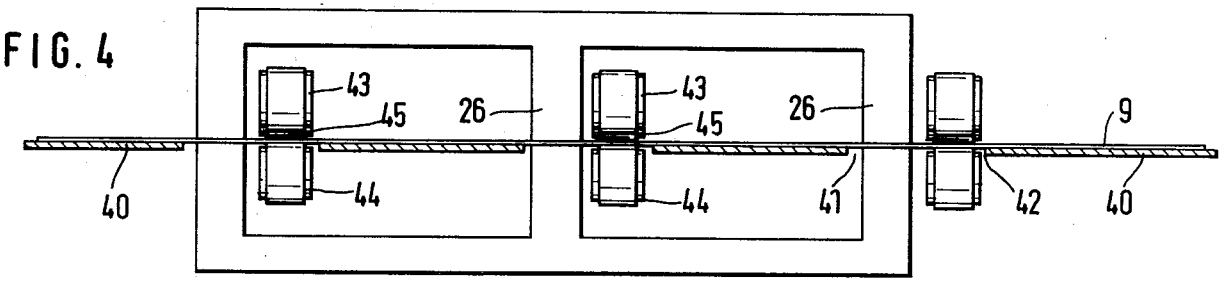
FIG. 2 is a plan view of the transfer device connecting the two double belt conveyors and FIG. 3 is a longitudinal section through the FIG. 2 transfer device and FIG. 4 is a section through the transfer device along the line IV—IV in FIG. 2.

A deflecting device 6 is provided to connect the tube-making machine 1 to the base-forming machine 2 that is adjacent thereto in parallel. The deflecting device consists of the double belt conveyors 7, 8 which comprise divided conveyor belts and are arranged in parallel with opposite conveying directions. Transversely in front of the delivery end of the double belt conveyor 7 and the intake end of the double belt conveyor 8 there is a double belt conveyor 5 which bridges the gap therebetween. The turning device 3 serves to transfer the tube sections 9 from the double belt conveyor 7 to the double belt conveyor 5 and it does not change the conveying direction of the tube sections 9 after rotation thereof through 90° relatively to the double belt conveyors 7, 5. The turning device 3 has a plurality of pairs of grippers, upper grippers 50 of each pair being illustrated in FIG. 1, which cooperate with each other in the manner of tongs and engage between every two conveyor belts of the double belt conveyors (7, 5). A control 52 ensures that the gripper halves are open when positioned between the belts of the double belt conveyor 7 to receive a tube section 9, are closed when the gripper halves are rotated from the belts of the conveyor 7 to the belts of the conveyor 5, and are opened to transfer the tube section 9 to the belts of the conveyor 5. The workpieces 9 are received by the gripper halves substantially tangentially from the supplying conveyor 7, rotated through 90°, and delivered substantially tangentially into the nip of the belt conveyor 5.

From the double belt conveyor 5, the workpieces 9 are transferred to the double belt conveyor 8 by the transfer device 4, the workpieces 9 being held parallel to themselves during transfer so that after transfer to the double belt conveyor 8 they are fed to the base-forming machine 2 in a transverse direction.

Figure 2:
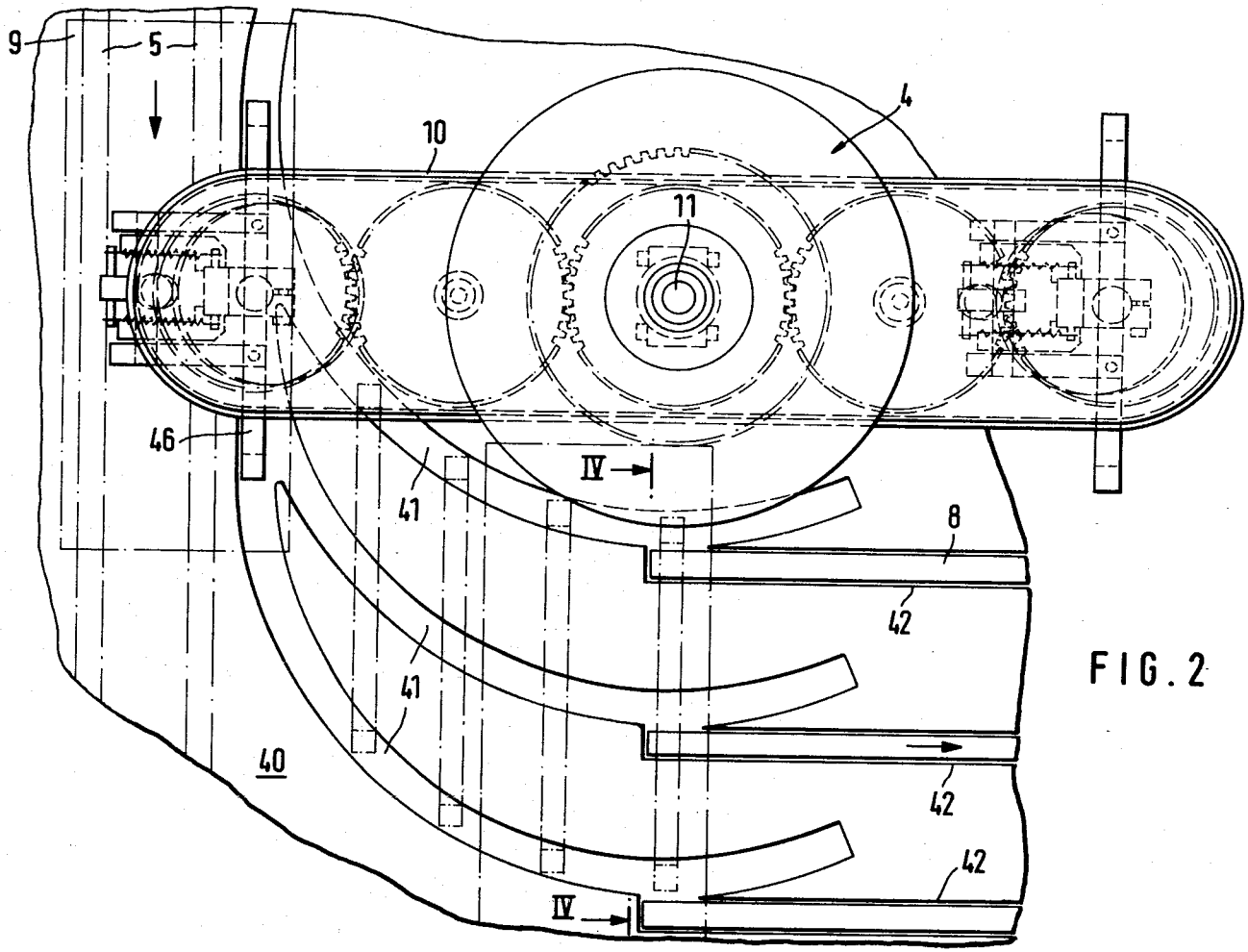

The transfer device 4 will be described in more detail with reference to FIGS. 2 and 3. The transfer device 4 consists of two symmetric halves disposed above and below the conveying planes of the tube sections 9. Since the components of each half are similar, only the upper half will be described. In a housing 10 forming a two-armed carrier, there are accommodated parallel guide gearings for the gripper halves 13, 14 disposed at the ends of the housing. The parallel guide gearing consists of a sunwheel 12 which is fixed with respect to the frame and engages planet gears 15, 16 mounted in the housing 10 which at the same time forms a planet carrier. The gears 17, 18 mounted in the housing 10 engage the planet gears 15, 16.

The housing 10 is secured to the shaft 19 which is rotatably mounted in the machine frame and keyed to the drive gear 20. The rotary axes 11 of the shafts 19 of the upper and lower halves of the transfer device 4 are in alignment with each other.

The gripper halves 13, 14 are secured to the shafts 21, 22 of the gears 17, 18. The gripper halves consist of Z-shaped carrier members 23, 24 on which there are pivotably mounted levers 27, 28 carrying the clamping jaws 25, 26. The two-armed levers 27, 28 are held in their closed position by tension springs 29, 30. The opening movement of the gripper halves is brought about by the cam rollers 31, 32 which are rotatably mounted on the one lever arm and which run on the cam tracks 33, 34 during rotation of the grippers.

The gripper halves each consist of three gripper jaws which are pivotably mounted on a shaft and engage between the divided conveyor belts.

The gripper halves desirably consist of clamping jaws which are secured to a carrier or transverse yoke 46 having a height greater than the height of the upper or lower belts of the double belt conveyor 8.

During transfer of the tube sections or workpieces 9 from the double belt conveyor 5 to the double belt conveyor 8 at right-angles thereto, they are slidingly displaced on the supporting plate 40 which defines the conveying plane. The plate 40 is provided with apertures 41 through which the co-operating clamping jaws 25, 26 of the gripper halves engage and tangentially adjoining apertures 42 on both sides of which the upper and lower belts of the double belt conveyor 8 are disposed.

Corresponding to the three parallel juxtaposed gripper jaws, the double belt conveyor consists of three spaced and parallel juxtaposed pairs of co-operating endless belts.

Figure 3:
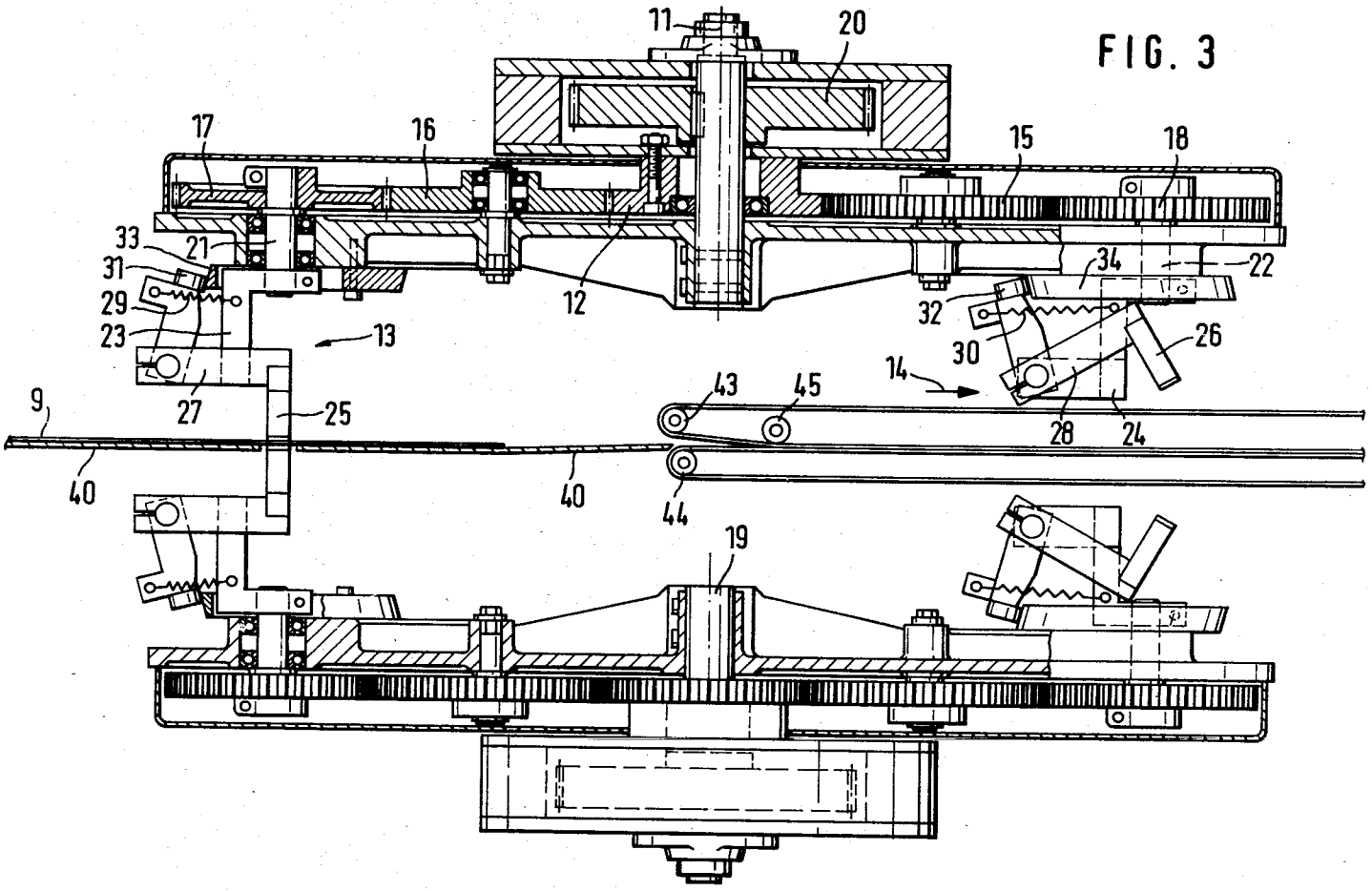

On the inlet side, the direction-changing rollers 43 of the upper belts of the double belt conveyor 8 are disposed somewhat in front of and higher than the direction-changing rollers 44 of the lower belts so as to form a tapered inlet nip which is best shown in FIG. 3. Spaced behind the direction-changing rollers 43 there are rollers 45 at a lower level for pressing the lower run of the upper belt against the upper run of the lower belt of the double belt conveyor 8. In this way one ensures that the double belt conveyor 8 will securely grip the workpieces 9 transferred to it by the grippers.

We claim:

1. Apparatus for deflecting continuously conveyed flat workpieces, preferably tube sections having side folds, through 180° while turning the workpieces through 90°, characterised by the following combination of features:

(a) two double belt conveyors (7, 8) comprising spaced conveyor belts travelling in parallel in opposite directions are spaced apart and parallel, (b) transversely to the double belt conveyors (7, 8) in front of the delivery and supply ends thereof, respectively, a double belt conveyor (5) bridges the spacing therebetween and has endless conveyor belts divided in the same manner, (c) on the inside of the angle formed by the transversely extending double belt conveyor (5) and one of the two parallel belt conveyors there are turning means (3) with at least two pairs of grippers which co-operate in the manner of tongs, are disposed on a radial line, engage between every two conveyor belts of the double belt conveyors (7, 5) and are provided with a control that opens the gripper halves when the conveyor belts are being passed and closes them between same, and that takes over the workpieces (9) from the supplying conveyor (7) substantially tangentially and, after rotation through 90°, delivers same substantially tangentially after their introduction into the belt nip of the following perpendicular double belt conveyor (5), (d) on the inside of the angle formed by the transversely extending double belt conveyor (5) and the other of the two parallel belt conveyors (8) there is a transfer device (4) consisting of at least one pair of parallel arms (10) which extend radially to their common rotary axis (11) and are provided with parallel guide gearing for a respective carrier (23, 24) near the ends of the arms that is secured to a shaft (21, 22) parallel to the rotary axis (11), wherein at least two gripper halves (25, 26) pivoted to each carrier (23, 24) co-operate in the manner of tongs with gripper halves on the opposite carrier and wherein the grippers formed by the gripper halves (13, 14) take over the workpieces (9) from the supplying double belt conveyor (5) substantially tangentially and deliver same substantially tangentially parallel to themselves into the belt nip of the following perpendicular double belt conveyor (8) and are provided with controls which open the gripper halves (13, 14) when the conveyor belts are being passed and close them again between same.

2. Apparatus according to claim 1, characterised in that the gripper halves consist of clamping jaws (25, 26) which are secured to a carrier or transverse yoke (46) and the height of which is larger than the height of the upper or lower belts of the double belt conveyor (8).

* * * * *